United States Patent [19]

Belanger

[11] Patent Number: 4,738,036

[45] Date of Patent: Apr. 19, 1988

[54] PEAT HARVESTER WITH AUTOMATICALLY ADJUSTABLE SUCTION HEADS

[76] Inventor: Bernard Belanger, 1403, 4ième Avenue, La Pocatière, Qc, Canada

[21] Appl. No.: 4,411

[22] Filed: Jan. 16, 1987

[30] Foreign Application Priority Data

Jan. 20, 1986 [CA] Canada ..... 499921

[51] Int. Cl.[4] ..... E21C 49/00

[52] U.S. Cl. ..... 37/3; 56/DIG. 15

[58] Field of Search ..... 37/3; 44/27, 28; 56/DIG. 15, 13.1, 13.2

[56] References Cited

U.S. PATENT DOCUMENTS

| | | | |
|---|---|---|---|
| 2,699,637 | 1/1955 | Nisbet | 56/13.1 X |
| 2,827,749 | 3/1958 | Patten | 56/13.1 X |
| 2,878,508 | 3/1959 | Sedgwick et al. | 56/13.1 X |
| 3,395,467 | 8/1968 | Allen et al. | 37/3 X |
| 3,728,851 | 4/1973 | Van Antwerp | 56/DIG. 15 |
| 4,261,163 | 4/1981 | Shaw | 56/DIG. 15 |
| 4,409,778 | 10/1983 | McNaught | 56/DIG. 15 |

FOREIGN PATENT DOCUMENTS

| | | | |
|---|---|---|---|
| 2148748 | 6/1985 | United Kingdom | 37/3 |

*Primary Examiner*—Clifford D. Crowder

*Attorney, Agent, or Firm*—Charles E. Brown; Charles A. Brown

[57] ABSTRACT

A peat harvesting machine having a peat collecting tank, and at least one collecting head with a peat inlet connected to the tank. Means are provided for setting the peat inlet at an optimum height above peaty ground to collect the peat. Means are provided on the machine for drawing peat up into the head and into the tank as the machine is moved over the ground. Means are also provided for automatically adjusting the height of each inlet as the machine moves to maintain each inlet generally at the optimum height irregardless of the changes in the contour of the ground.

The invention is also directed toward a method of harvesting peat using the above machine.

5 Claims, 4 Drawing Sheets

PEAT HARVESTER WITH AUTOMATICALLY ADJUSTABLE SUCTION HEADS

BACKGROUND OF THE INVENTION

This invention is directed toward an improved peat harvesting method. The invention is also directed toward an improved, mobile, peat harvesting machine for carrying out the method.

Mobile, peat harvesting machines are well known and comprise a wheeled chassis having a peat collecting tank thereon. A peat collecting head is mounted on the unit and is operatively connected to the tank with a duct. Means on the chassis mount the collecting head with its inlet close to the ground. Fan means are provided for creating a reduced or negative pressure at the inlet of the collecting head so that peat can be drawn up off the ground into the collecting head and passed through the duct into the collecting tank. Means are also provided for manually adjusting the height of the inlet in the collecting head above the ground. This height is adjusted to obtain the most efficient collection of peat and is dependent, among other things, on the dryness and the density of the peat, and the power of the fan.

In use, the known peat harvesting machine is pulled along over the peat to be harvested by a tractor with the inlet of the collecting head set at the optimum height above the peat, and with the fan operating. As the machine moves along, peat is drawn up from the ground by the collecting head and deposited in the tank. The tractor operator drives the machine in a genrerally straight line and at the same time tried to keep a watch on the harvesting machine behind to ensure that the inlet on the collecting head is always at the optimum height relative to the peat being collected. Often the collecting head, set to one side of the wheeled chassis carrying the tank, will pass over hollows or mounds that do not affect the chassis carrying the head. The tractor operator however looks for the hollows or mounds and tries to manually adjust the height of the collecting head with suitable actuating means from his seat on the tractor so that the inlet of the head generally follows the contour of the land at the optimum height.

It can be difficult for the tractor operator to keep both the tractor on line, and the inlet on the collecting head at the optimum height. Usually the height of the inlet in the collecting head varies considerably due to slow responses from the operator to a change in contour. When the inlet height varies, so does the peat collection efficiency. If the inlet height increases, from the optimum height, less peat is picked up blocking the inlet. In addition, the inlet in the collecting head could be damaged if the head touches the ground. Because of the difficulty in keeping both the tractor on line, and the inlet on the collecting head generally at the optimum height, the amount of peat collected during each run is quite variable.

SUMMARY OF THE INVENTION

It is the purpose of the present invention to greatly increase the efficiency of the peat collection operation. In accordance with the present invention, means are provided to automatically have the inlet on the peat collecting head follow the contour of the ground at the optimum height. This frees the driver to concentrate only on moving the harvesting unit in a straight line. More importantly, since the peat collecting head inlet is automatically maintained at the optimum height, without the driver's help, more than one such head can be employed with each machine with each head collecting peat at maximum efficiency. For example, four such heads, set up to cover a wide harvesting swath, can be employed on one machine. It would be impossible for the tractor operator to manually control the height of the inlet of each of the four collecting heads independently while simultaneously driving the tractor. However, when each inlet has its height automatically controlled there is no problem for the tractor operator. He merely has to drive the tractor. The efficiency of the unit, it will be obvious, is greatly increased. This is not only because more collecting heads can be used on each tractor run, thereby collecting peat over a wider swath during each run, but also because each collecting head independently and automatically follows the ground contour at the optimum height.

The invention is particularly directed toward a method for collecting peat using a mobile peat harvesting unit which comprises: a collecting tank, at least one peat collecting head with a peat inlet, means connecting each collecting head to the collecting tank, means for adjusting the height of the inlet in each head, and means for drawing peat into the collecting tank through each collecting head. The method comprises the steps of: initially positioning each collecting head inlet at an optimum height above the peat; operating the peat drawing means; moving the machine over the peat; and automatically adjusting the height of each collecting head inlet to generally follow the contour of the peat beneath it at the desired optimum height as the machine is moved over the peat.

The invention is also particularly directed toward a mobile peat harvesting machine having a peat collecting tank and at least one peat collecting head with a peat inlet. Means connect each collecting head to the collecting tank. Means are also provided for drawing peat into the collecting tank through the inlet of each collecting head and the associated connecting means. Means are provided for initially setting the inlet of each collecting head at an optimum height above the peat to be harvested. Means are also provided for automatically maintaining the inlet of each collecting head at the optimum height above the peat as the machine is being moved over the peat.

DETAILED DESCRIPTION OF THE DRAWINGS

Figure 1:
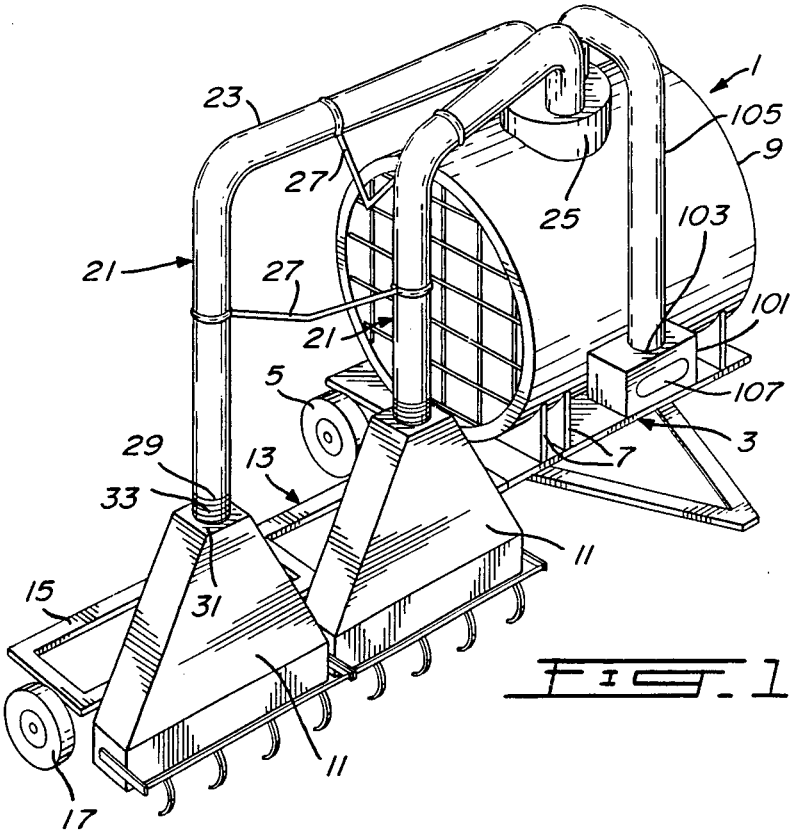
FIG. 1 is a perspective front view of the machine.
Figure 2:
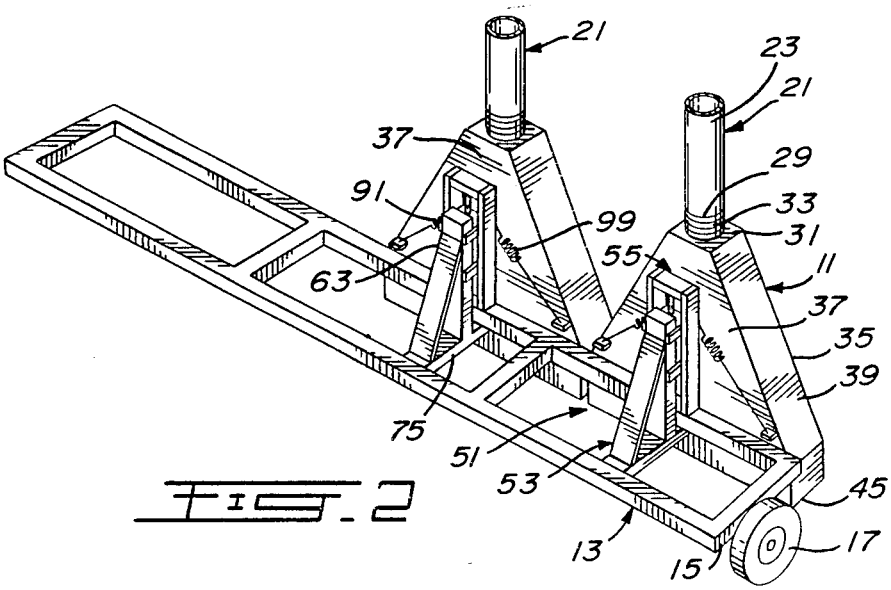
FIG. 2 is a detail perspective rear view of the collecting heads.
Figure 3:
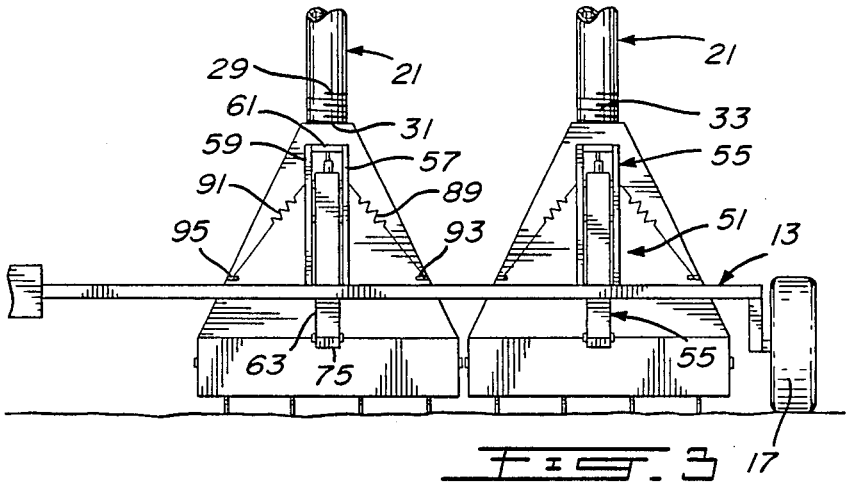
FIG. 3 is a rear view of the collecting heads.
Figure 4:
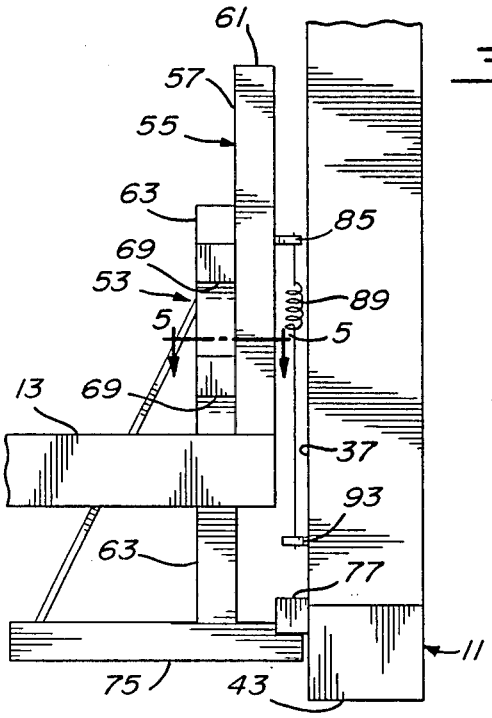
FIG. 4 is a side view showing the mounting of one collecting head.
Figure 5:
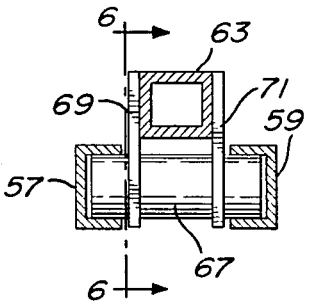
FIG. 5 is a cross-section view taken along line 5—5 in FIG. 4.
Figure 6:
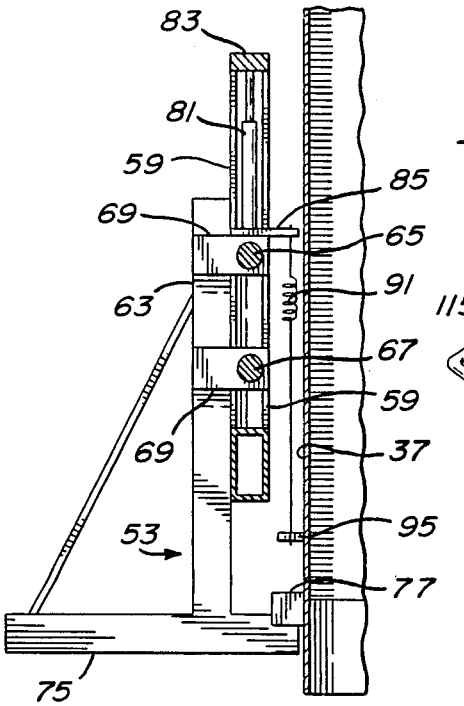
FIG. 6 is a cross-section view taken along line 6—6 in FIG. 5.

The invention will now be described in detail having reference to the accompanying drawings:

The mobile peat harvesting machine 1, as shown in FIGS. 1 and 2, has a chassis 3 mounted on several pairs of wheels 5 so that the machine can be pulled over peaty ground by a tractor. Mounted on the chassis 3, by suitable frame members 7, is a large, cylindrical, peat collecting tank 9. The machine 1 also has several peat collecting heads. Two such heads 11 are shown in FIGS. 1 and 2. The heads 11 are generally mounted side by side on a support frame 13 that extends laterally from one side of the chassis 3. The outer end 15 of the support frame 13 carries a wheel 17 to help support the frame 13 and the collecting heads 11 that it carries.

Each collecting head 11 is connected to the collecting tank 9 by a collecting duct 21. The collecting duct 21 has a long, rigid, tubular portion 23 extending outwardly and downwardly from an inlet 25 on the top of the tank 9. Brace members 27, extending from the tank 9 and chassis 3, hold the rigid duct portion 23 in place. The lower end 29 of the rigid duct portion 23 is located just above the top, central outlet 31 of the collecting head 11. A short, extensible, tubular section 33, forming part of the collecting duct 21, connects the lower end 29 of the rigid duct portion 23 to the outlet 31 of the collecting head 11.

The extensible duct section 33 allows the head 11 to move vertically relative to the rigid portion 23 of the duct. The same effect cold be achieved by employing telescopic connections between the head 11 and the rigid duct portion 23.

Each collecting head 11 has a generally triangular shape defined by front and back walls 35, 37 and side walls 39 as shown in FIG. 2. The bottom of the collecting head is open and defines an inlet 43 having a long, narrow, elongate shape. The top, outlet opening 31, is circular in shape and generally of the same size as the inlet 43.

Each collecting head 11 is located just in front of the support frame 13 and is mounted for movement relative to the frame 13. Mounting means 51 connect the head 11 to the frame 13 in a manner that the head 11 can be moved vertically, and tilted sideways, relative to the frame. The mounting means 51 as shown in FIGS. 3 to 6 includes a mounting frame 53 that is vertically movable in a fixed carrying frame 55 on the support frame 13. The fixed carrying frame 55 has a pair of facing channel members 57, 59 extending vertically up from the front of the support frame 13. A cross-piece 61 connects the channels together at their top ends. The mounting frame 53 has a vertical post 63 positioned just behind the channel members 57, 59 in the fixed carrying frame 55. The post 63 carries a pair of vertically spaced-apart rollers 65, 67 that are mounted on the post 63 by brackets 69, 71. Each roller 65, 67 projects laterally past the brackets 69, 71 to extend into both channel members 57, 59 and to be guided by the channel members during vertical movement of mounting frame 53. The post 63 on the mounting frame 53 extends below the support frame 13. A horizontal cross-piece 75 at the bottom of the post 63 extends forwardly of the support frame 13 and connects to a bracket 77 on the back wall 37 of the collecting head 11, near the inlet 43 to support the head 11. The bracket 77 is centrally located on the head 11, and the head 11 can tilt slightly to either side of the cross-piece 75 where it connects to the bracket 77.

Means are provided for moving the mounting frame 53 vertically in the carrying frame 55 to adjust the height of the head 11 relative to the support frame 13. These means can comprise a hydraulic cylinder 81 mounted between a fixed base 83 extending between the channel members 57, 59 on the carrying frame 55, and a top plate 85 extending forwardly from the top of the post 63 on the mounting frame 53. Extension or retraction of the cylinder 81 will move the mounting frame 53, and thus head 11, up or down relative to the carrying frame 55.

The top plate 85 on the mounting frame 53 projects forwardly toward the collecting head 11. A pair of springs 89, 91 extend downwardly and outwardly from the plate 85 to brackets 93, 95 on the lower, side portions of the back wall 37 of the collecting head 11. The brackets 89, 91 retain the collecting head 11 in an upright position relative to its mounting on the cross-piece 75. The head 11 can tilt side-ways in either direction about cross-piece 75, but the springs 89, 91 will always return the head to an upright position.

A fan 101 is mounted on the chassis basis 3 as shown in FIG. 1. The inlet 103 to the fan 101 is connected to the inlet 25 on the tank 9 by an exhaust duct 105. The outlet 107 from the fan opens to atmosphere. The fan is powered by a driving shaft connected to the power take off of the tractor's motor 215.

Figure 8:
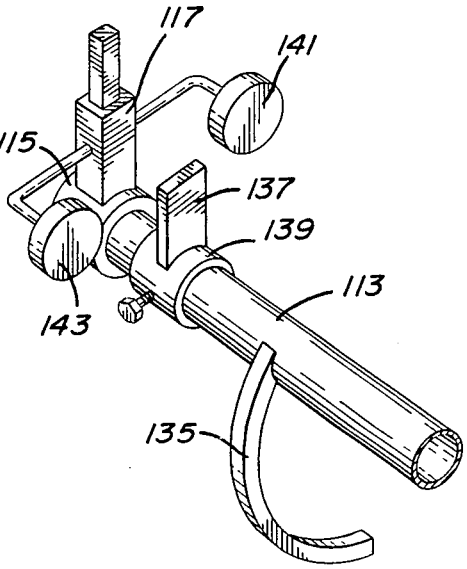
FIG. 8 is a detail view of the sensing means.
Figure 7:
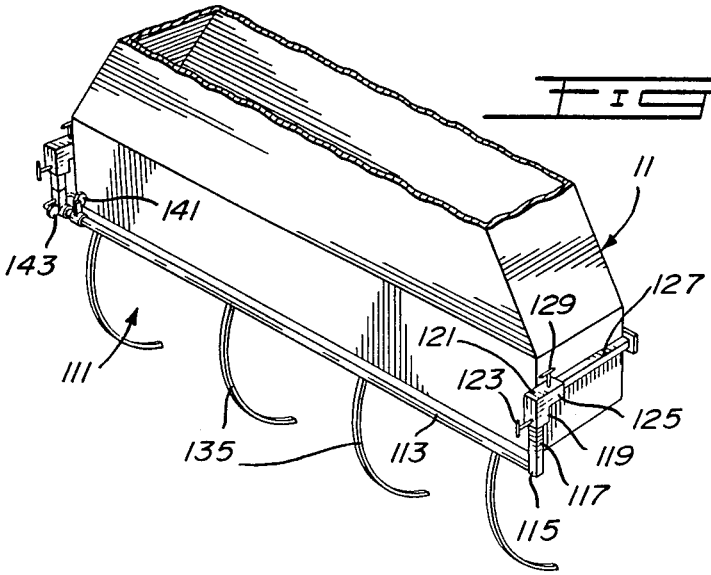
FIG. 7 is a detail perspective front view of a collecting head.

Means are provided for sensing variations in the distance between the inlet 43 of each collecting head 11 and ground. The sensing means 111, as shown in FIGS. 7 and 8 comprises a carrying rod 113 that is rotatably mounted at each end at the bottom end 115 of a support arm 117. The rod 113 is located just in front of the head 111, and just above its inlet 43. Each support arm 117 is slidably mounted in a hollow vertical leg 119 of a mounting bracket 121. A locking screw 123 connects the support arm 117 within the leg 119. Each mounting bracket 121 also has a hollow horizontal leg 125. The horizontal leg 125 slidably receives a horizontal support 127 fastened to the side of the head 11. Another locking screw 129 holds the support 127 in place. The locking screws 123, 129 in each bracket 121 permit the position of the carrying rod 113, relative to the head 11, to be adjusted.

A series of longitudinally spaced-apart, curved, sensing bars 135 are fixedly carried by the carrying rod 113. Each sensing bar 135 is mounted to the rod 113 in a slightly forwardly offset position and curves downwardly and rearwardly under the rod. A metal plate 137 is mounted on a collar 139 that in turn, is adjustably mounted on the carrying rod 113 at one end and extends radially upwardly therefrom. A pair of metal detecting sensors 141, 143 are fixedly mounted on the support arm 117. Each sensor 141, 143 preferably is an electro-magnetic sensor of the type where an electro-magnetic field changes as metal passes close by.

One sensor 141 is normally located on one side of plate 137 and the other sensor 143 is normally located on the other side of plate 137, with both sensors 141, 143 located on the same side adjacent the plane of movement of the plate 137 as it rotates. The sensors 141, 143 control hydraulic means (not shown) which operate the hydraulic cylinder 81 to automatically raise or lower the collecting head 11 so its inlet 43 closely follows the contour of the ground that it is passing over.

Figure 9A:
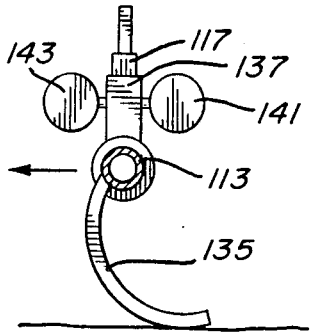
FIGS. 9A, 9B, and 9C are views of the sensing means in operation.

In operation, the height of each collecting head 11, and thus its inlet 43, on the machine 1 is preset at the desired, optimum height from the ground to collect peat at maximum efficiency. This height would depend on the dryness of the peat, and its density, among other factors. The height of the carrying rod 113 for the sensor bars 135 is adjusted at the same time so that when the heads 11 pass over the ground at the optimum height, the sensing bars 135, as shown in FIG. 9A, just touch the ground with the sensor plate 137 located between the sensors 141, 143. The fan 101 is started, so as to draw air through the inlets 43 of the collecting heads 11, through the ducts 21, the tank 9, and the duct 105. The machine 1 is then towed via a towbar 151, along the ground over the peat to be collected, by a tractor. As the machine 1 is being towed, relatively dry peat is being sucked up in the collecting heads 11 through the inlets 43 and deposited in the tank 9. The two collecting heads 11, located side by side, collect peat over a wide swath. The tractor driver merely has to drive in a straight line. If either collecting head 11 passes over a rise or a hollow in the ground, the sensing means 111 detects the change in contour and automatically adjusts the height of the head 11 so that its inlet stays at the same optimum height whether passing over a rise or a hollow.

Figure 9B:
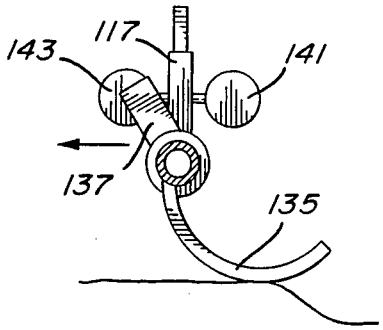

If the collecting head 11 passes over a rise, one or more of the contact bars 135 will drag along the rise and rotate the rod 113 counter-clockwise as seen in FIG. 9B. As the rod 113 rotates, the metal plate 137 is moved in front of magnetic sensor 143. The sensor detects the closer presence of the plate, and as a result, instructs the hydraulic control to shorten the actuator 81 so as to raise the collecting head 11. As the collecting head 11 is raised, the unbalanced weight of the sensing bars 135, will return the rod 113 to its initial position and the plate 137 will move back to a mid-point between the sensors 141, 143. As this occurs, the control shuts off the actuator 81.

Figure 9C:
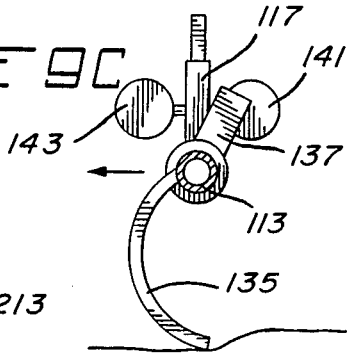

If the collecting head 11 passes over a hollow, as shown in FIG. 9C, the sensing bars 135 will cause the rod 113 to rotate clockwise moving the plate 137 closer to sensor 141. This sensor, in sensing a change in the position of the plate 137, will cause the hydraulic control to lengthen the actuator 81 thus moving the collecting head 11 down until the sensing bars 135 will again just drag along the ground. Thus each collecting head 11, and its inlet 43, is independently and automatically maintained at the desired optimum height to collect peat most efficiently. The mounting of each collecting head to its mounting frame allows the heads some sideways swinging movement to accomodate larger bumps.

While one form of height sensing means has been described, it will be obvious that other types of sensing means can also be employed. Also, while one type of mounting and adjusting means for the collecting head has been described, it will be obvious that other types of mounting and adjusting means can be employed to vary the height of the head.

Figure 10:
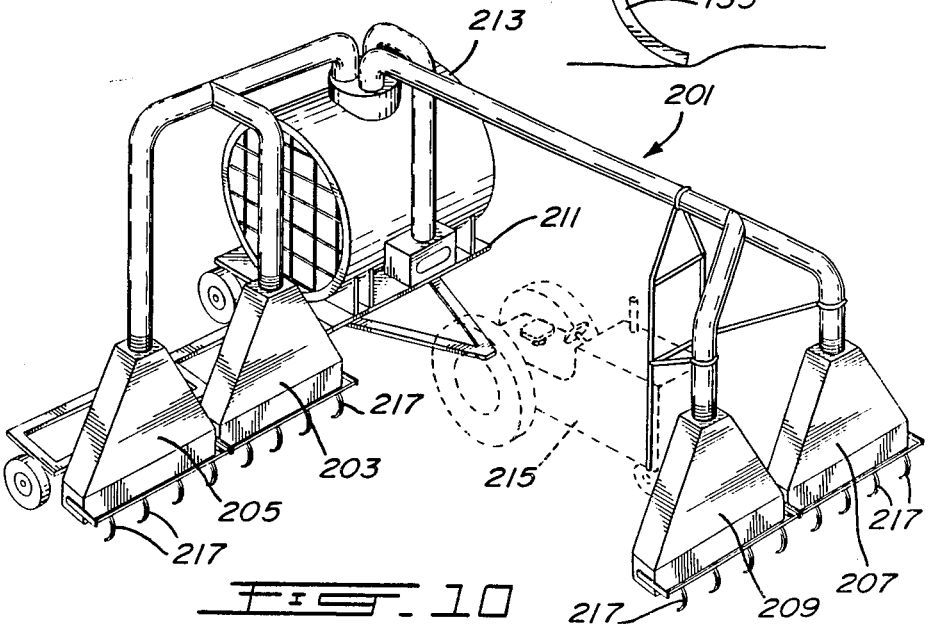
FIG. 10 is a perspective front view of another embodiment of the machine.

The embodiment described employs two collecting heads. However machines with three or more heads can be employed to harvest over a wide swath. FIG. 10 illustrates a peat harvesting machine 201 employing four collecting heads 203, 205, 207, 209 with two of the heads 203, 205 carried on the side of a chassis 211 carrying the collecting tank 213 as before, and with the other two heads, 207, 209 mounted in front of the tractor 215 pulling the machine. Each head carries sensing means 217 so that each head can be independently and automatically adjusted to generally remain at the optimum height above the ground during operation, irregarless of changes in contour.

The embodiments of the invention in which an exclusive property or privilege is claimed as defined as follows:

1. A method of harvesting peat comprising steps of: initially setting each of at least two side-by-side independent peat collecting suction heads on a peat harvesting machine to have their inlets at an optimum peat collecting height above the peat to be harvested; moving the machine to move the inlets in unison over the peat to be harvested; drawing up the peat to be harvested into each inlet solely by applying a reduced pressure to each inlet; sensing changes in the contour of the peat in front of each inlet; and automatically adjusting the vertical position of each suction head, in response to sensed contour changes in front of each head, independently of the other heads, to maintain its inlet at about the optimum height regardless of the changes in the contour of the peat.

2. A mobile peat harvesting machine having a chassis; a peat receiving tank mounted on the chassis; a main frame mounted to the chassis; at least two secondary frames mounted on the main frame, each secondary frame vertically movable on the main frame independently of the other secondary frames; a peat collecting suction head mounted on each secondary frame with the suction heads located side-by-side; each suction head having a bottom-opening peat collecting inlet; a single duct connecting each suction head to he peat receiving tank; means for creating a reduced pressure in the tank and at each inlet to collect peat in the tank through each suction head; each suction head having its inlet initially located at an optimum peat collecting height; sensing means mounted on the front of each suction head to sense changes in the contour of the peat in front of the head when the machine is operating; and moving means operated by each said sensing means for automatically moving the related secondary frame to adjust the height of the respective suction head to maintain its inlet at about the optimum height regardless of any change in the contour of the peat that each head is passing over.

3. A mobile peat harvesting machine as claimed in claim 2 where said sensing means includes a generally horizontal rod rotatably mounted in front of each head, and rigid sensing bars fixed to the rod at longitudinally, spaced-apart locations, and extending downwardly, mounting means on the suction head, and means on the rod adjustably connecting it to the mounting means to have the bars just touch the ground when the inlets are at the optimum height.

4. A mobile peat harvesting machine as claimed in claim 2 including a bracket at the bottom center of each suction head for pivotally mounting the head on the secondary frame, and resilient means connected between the head and the secondary frame for returning the head to a vertical position on its pivot mounting.

5. A mobile peat harvesting machine as claimed in claim 2 including a vertical support on the main frame defining a pair of facing guide tracks, and a pair of vertically spaced apart rollers on the secondary frame movable in the guide tracks to guide the secondary frame for vertical movement relative to the main frame.

* * * * *